United States Patent [19]

Ramsaier et al.

[11] Patent Number: 4,916,904

[45] Date of Patent: Apr. 17, 1990

[54] INJECTION ELEMENT FOR A COMBUSTION REACTOR, MORE PARTICULARLY, A STEAM GENERATOR

[75] Inventors: Manfred Ramsaier, Neulautern; Hans J. Sternfeld, Jagsthausen; Karlheinz Wolfmüller, Eppingen-Adelshofen, all of Fed. Rep. of Germany

[73] Assignee: Deutsche Forschungs- und Versuchsanstalt fur Luft und Raumfahrt e.V., Cologne, Fed. Rep. of Germany

[21] Appl. No.: 405,054

[22] Filed: Sep. 7, 1989

Related U.S. Application Data

[63] Continuation of Ser. No. 153,500, Feb. 11, 1988, abandoned, which is a continuation of Ser. No. 849,142, Apr. 7, 1986, abandoned.

[30] Foreign Application Priority Data

Apr. 11, 1985 [DE] Fed. Rep. of Germany ..... 3512948

[51] Int. Cl.[4] ..... F02C 3/22

[52] U.S. Cl. ..... 60/723; 60/737; 431/158; 431/268

[58] Field of Search ..... 60/722, 723, 737, 740, 60/742, 738; 431/2, 158, 187, 354, 268

[56] References Cited

U.S. PATENT DOCUMENTS

| | | | |
|---|---|---|---|
| 2,572,338 | 10/1951 | Hartwig et al. | 431/158 |
| 3,685,950 | 8/1972 | Nomaguchi et al. | 431/350 |
| 3,943,705 | 3/1976 | De Corso et al. | 60/723 |
| 4,047,877 | 9/1977 | Flanigan | 60/723 |
| 4,080,150 | 3/1978 | Hunter et al. | 431/268 |
| 4,112,675 | 9/1978 | Pillsbury et al. | 60/723 |
| 4,118,171 | 10/1978 | Flanagan et al. | 60/723 |
| 4,260,367 | 4/1981 | Markowski | 60/742 |
| 4,377,067 | 3/1983 | Sternfeld et al. . | |
| 4,545,430 | 10/1985 | Retallick | 431/158 |
| 4,830,604 | 5/1989 | Korenberg | 431/158 |

FOREIGN PATENT DOCUMENTS

| | | | |
|---|---|---|---|
| 966677 | 8/1957 | Fed. Rep. of Germany | 60/722 |
| 2031002 | 1/1971 | Fed. Rep. of Germany . | |
| 977219 | 12/1964 | United Kingdom . | |

*Primary Examiner*—Louis J. Casaregola
*Assistant Examiner*—Timothy S. Thorpe
*Attorney, Agent, or Firm*—Wolf, Greenfield & Sacks

[57] ABSTRACT

The injection element comprises a fuel inlet, an oxidant inlet, a mixing chamber for fuel and oxidant, and an ignition device for a mixture of fuel and oxidant. To ensure optimum mixing of the reaction components and efficient ignition even in the case of small reactors, the fuel inlet opens into an ignition chamber having a widened flow cross-section, the ignition chamber has an outlet having a cross-section smaller than the flow cross-section of the ignition chamber, the outlet of the ignition chamber and the oxidant inlet open into the mixing chamber, an ignition oxidant inlet opens into the ignition chamber and the ignition device is disposed in the ignition chamber immediately upstream of its outlet.

9 Claims, 1 Drawing Sheet

INJECTION ELEMENT FOR A COMBUSTION REACTOR, MORE PARTICULARLY, A STEAM GENERATOR

This application is a continuation, of application Ser. No. 153,500, filed Feb. 11, 1988, now abandoned, which is a continuation of Ser. No. 849,142, now abandoned.

BACKGROUND TO THE INVENTION

1. Field of Invention

The invention relates to an injection element for a combustion reactor, more particularly a steam generator, in which a fuel and an oxidant are mixed and reacted, comprising an inlet for the fuel, an inlet for the oxidant, a mixing chamber for the fuel and oxidant, and ignition means for a mixture of fuel and oxidant.

Combustion reactors of this kind can be used for various reactants, e.g. if the fuels can be hydrocarbons and the oxidant is preferably oxygen gas or other oxygen-yielding gases. A reactor of this kind is particularly suitable for using hydrogen gas as a fuel and oxygen gas as an oxidant, since a device of this kind is suitable for generating steam at high temperatures. Hereinafter, to explain the invention, reference will be made exclusively to the aforementioned steam generators and corresponding injection elements, although it is expressly pointed out that the injection element according to the invention can also be used for other reactants.

2. Description of prior Art

A steam generator is known from German patent Specification No. 29 33 932. The steam generator described therein is used mainly for producing steam for power stations, i.e. the known steam generator is of use in large plants where large quantities of steam are needed.

SUMMARY OF THE INVENTION

Starting from this known reactor operating as a steam generator, the object of the invention is to propose an injection element for introducing a fuel and an oxidizer into a reactor, such that the reaction components can be reliably ignited and simultaneously efficiently mixed in a very small space.

To this end, according to the invention, in an injection element of the initially-described kind, the fuel inlet opens into an ignition chamber having a widened flow cross-section, the ignition chamber has an outlet having a cross-section smaller than the flow cross-section of the ignition chamber the outlet of the ignition chamber and the oXidant inlet open into the mixing chamber, an ignition oxidant inlet opens into the ignition chamber, and the ignition means is disposed in the ignition chamber immediately upstream of the outlet.

In this total system, therefore, a small proportion of ignition oxidant is added to the fuel to ignite it. The mixture is ignited in a special ignition chamber, immediately in front of its outlet, in front of which the ignition mixture is slowed down by a transverse constriction. The ignited mixture, together with the main oxidant supply, enters a mixing chamber where the reactants are intimately mixed, so that the gas mixture emerging from the mixing chamber can burn completely. After ignition, the supply of ignition oxidant to the ignition chamber can be stopped, after which fuel only is conveyed through the ignition chamber to the mixing chamber.

Advantageously, the oxidant inlet into the mixing chamber is substantially coaxially surrounded by the outlet of the ignition chamber. There then occurs in the mixing chamber especially effective intermixing of both gas components.

In a preferred embodiment the oxidant inlet extends coaxially through the ignition chamber, i.e. the ignition chamber surrounds the central oxidant inlet and forms an annular chamber.

Advantageously the fuel inlet extends parallel to the longitudinal axes of the ignition chamber in immediate neighborhood of the walls of the ignition chamber and/or the outer wall of the oxidant inlet and over the entire periphery of the walls and opens into the ignition chamber.

In that case the fuel forms a layer of gas flowing at high speed along the walls and efficiently cooling the walls of the ignition chamber and/or the walls of the central oxidant inlet.

According to an advantageous optional feature, the ignition oxidant inlet likewise extends parallel to the longitudinal axes between a first fuel inlet adjacent the wall of the ignition chamber and a second fuel inlet adjacent the outer wall of the oxidant inlet and opens into the ignition chamber.

This construction ensures that the ignition oxidant is thoroughly mixed with the fuel in the ignition chamber.

Optionally also, the ignition chamber forms a pre-mixing chamber between the openings of the oxidant inlet and the ignition oxidant inlet on the one hand and the ignition device on the other hand, the cross-section of the pre-mixing chamber be less than the cross-section of the part of the ignition chamber downstream of the pre-mixing chamber so that the flow speed in the pre-mixing chamber is greater than the flame propagation speed.

This prevents the flame ignited in the ignition chamber from flashing back towards the opening of the gas inlets.

The gas components can be particularly efficiently mixed if the mixing chamber tapers in the flow direction.

In a first preferred embodiment, the ignition means is disposed in a cavity opening laterally into the ignition chamber so that the reactants flow directly past the ignition means.

In another embodiment, the ignition means is a catalyst substance disposed in the ignition chamber and through which the fuel and oxidant flow.

In both cases the ignition means is disposed immediately in front of the outlet, where the flow speed of the reactants is higher, thus ensuring that any reaction products produced by combustion in this region, e.g. steam in the case of a steam generator, are removed together with the reaction products from the ignition device, so that reaction products cannot accumulate at the ignition means and interfere with its operation.

The following description of preferred embodiments of the invention will provide a more detailed explanation in conjunction with the accompanying drawings.

DETAILED DESCRIPTION OF PREFERRED EMBODIMENTS

Figure 1:
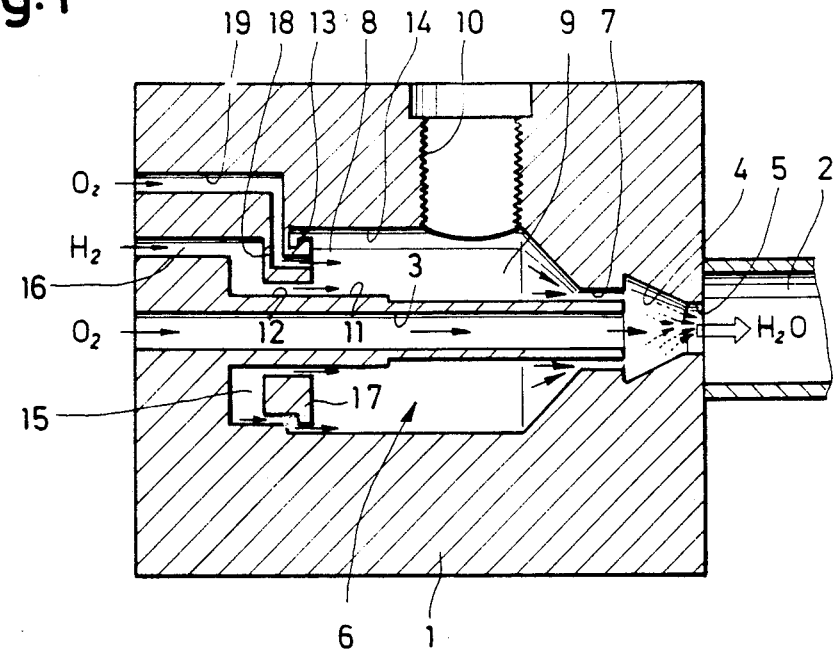
FIG. 1 is a diagrammatic view in longitudinal section through an injection element.

The injection element shown in FIG. 1 is described in conjunction with a steam generator. i.e. it is used for supplying hydrogen and oxygen gas. It is enclosed in a casing block adjacent a combustion chamber 2 (not shown in detail) of a steam generator. A central bore extends through block 1 and is connected to an oxygen source (not shown in the drawing) and forms an oxygen inlet 3. Inlet 3 opens into a mixing chamber 4 which tapers conically in the flow direction, is disposed concentrically to the oxygen inlet 3, and, at the side where inlet 3 opens, has a cross-section greater than the cross-section of inlet 3. The conically tapering mixing chamber 4 opens into an outlet 5 which opens into the combustion chamber 2.

A central oxygen inlet is surrounded by an annular ignition chamber 6 which tapers conically upstream of the mixing chamber 4 and is connected thereto by a narrow annular gap 7 concentrically surrounding inlet 3.

Ignition chamber 6 is divided into an upstream pre-mixing chamber 8 and an ignition compartment 9 disposed between chamber 6 and annular gap 7 and connected to a lateral cavity 10. Cavity 10 contains an ignition device, e.g. a heater plug or an ignition electrode. Cavity 10 can be constructed as a known $H_2$ resonance pipe, which can be used for ignition.

The through cross-section of the pre-mixing chamber is less than the cross-section of ignition compartment 9. To this end, in the illustrated embodiment, the wall 11 of the oxygen inlet 3 is made thicker near the pre-mixing chamber than near the ignition compartment. In this manner, the flow near the pre-mixing chamber 8 can be kept at a speed greater than the flame propagation speed, i.e. so as to prevent a flame ignited in the ignition compartment 9 from migrating back to the pre-mixing chamber 8.

Two concentric annular gaps 12,13 open into the pre-mixing compartment 8, the inner gap 12 being immediately adjacent the wall 11 of inlet 3 whereas the outer gap 13 is immediately adjacent the wall 14 of chamber 8. Gaps 12 and 13 are both connected to an annular distribution chamber 15 into which a hydrogen inlet 16 opens parallel to the oxygen inlet 3. Inlet 16 is connected to a hydrogen source (not shown in the drawing).

Annular gaps 12,13 are specially disposed near walls 11,14 respectively so that hydrogen gas entering the pre-mixing chamber flows in the form of a thin layer along the wall 11 of inlet 3 and wall 14 of chamber 8, and thus cools these walls very efficiently.

Gaps 12,13 and chamber 15 are formed by a ring 17 coaxially surrounding the oxygen inlet 3 and secured to a block 1 by webs 18. An ignition oxygen inlet 19 connected to an oxygen source (not shown) extends through one of the web 18 into ring 17 and opens into the pre-mixing chamber 8 in axially parallel manner between the two gaps 12 and 13; as see in the axially direction of the ignition chamber 6, inlet 19 opens into the region containing cavity 10 containing the ignition device.

In order to operate the driven injection element, oxygen and hydrogen are introduced in stoichiometric ratio through inlet 3 and inlet 16 Oxygen for ignition is also supplied through the ignition oxygen inlet; this oxygen can be taken from the oxygen conveyed through the central inlet 3 so as to preserve the total stoichiometric ratio, or alternatively oxygen gas can be introduced through the ignition inlet 19.

The ignition oxygen gas mixes intensively in pre-mixing chamber 8 with the hydrogen flowing through gaps 12 and 13 In the region in front of cavity 10 containing the ignition device, the gas mixture is held back by the constriction in ignition chamber 6, so that the ignitable gas mixture can be ignited here by the ignition device. As a result of the high flow speed in the pre-mixing chamber 8, the ignition flame cannot propagate in the opposite direction to the flow, but is conveyed through gap 7 into chamber 8 and thence into the actual combustion chamber 2. As soon as ignition has occurred here, the supply of oxygen through the ignition inlet 19 can be shut off and the ignition device is switched off. Ignition chamber 6 is then flowed through by hydrogen gas only, which in chamber 4 meets the oxygen from the central inlet 3 and, owing to the constriction in mixing chamber 4, mixes intensively therein with oxygen. This ensures complete combustion of the gas mixture in the adjacent combustion chamber 2.

Figure 2:
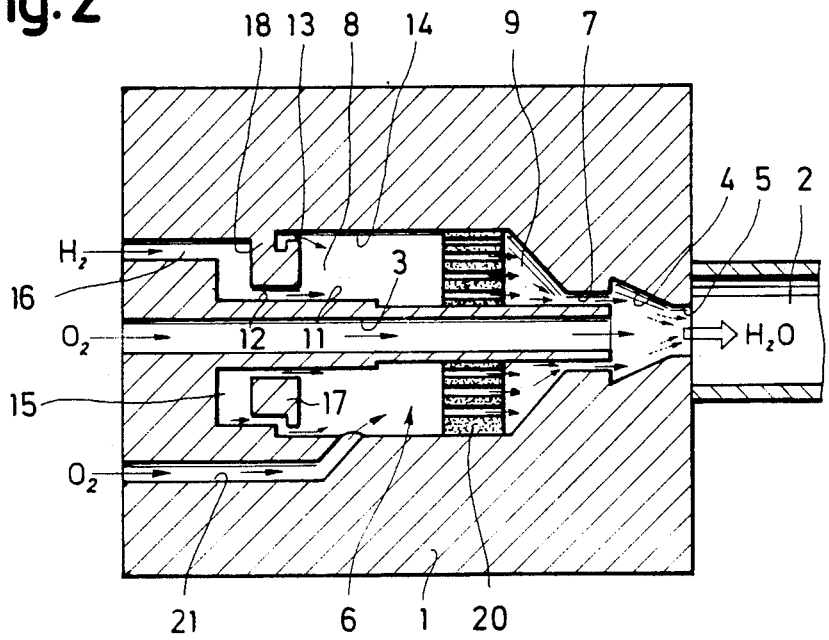
FIG. 2 is a view corresponding to FIG. 1 of a variant embodiment of an injection element.

The variant embodiment of an injection element shown in FIG. 2 differs only slightly from FIG. 1, and accordingly like parts bear the same reference numbers. The embodiment in FIG. 2 does not have a cavity 10 containing an ignition device; instead, a catalytic ignition member 20 is inserted in the ignition chamber 9 between the central oxygen inlet 3 and the wall 14, and all the gas travelling through the ignition chamber flows through the ignition member. An ignitable gas mixture is ignited in this ignition device, which can be a known ceramic catalyst.

In the illustrated embodiment the ignition oxygen inlet does not open into the pre-mixing chamber via ring 17 but via an inlet pipe 21 entering the side of the pre-mixing chamber. In this case, as a result of the slowing down of the gas in the annular ignition catalyst, the two gas components are adequately mixed even with this substantially radial method of introduction. In other respects this injection element is operated in the same manner as in FIG. 1.

In both cases, to ensure efficient ignition, it is essential that the ignitable gas mixture in the ignition chamber is slowed down by the large cross-section thereof and thus has a low flow speed in this part of its travel, so that efficient combustion can occur, but without the ignition reaction being able to propagate in the opposite direction to the flow. Consequently an initially large flow speed is followed by deceleration and then by acceleration in the flow direction, by correspondingly narrowing the flow path.

The described injection element can immediately prepare hot steam at or above boiling point at low power range of 1 to 500 kW, e.g. for supplying sterilizers. Continuous and intermittent operation are both possible, and the steam level and output can be kept variable or constant at choice.

We claim:

1. An injection element for a combustion reactor in which hydrogen and oxygen are mixed and reacted prior to being fed in a stoichiometric ratio to a main combustion chamber, comprising an inlet for the hydrogen, an inlet for the oxygen, a mixing chamber for the hydrogen and oxygen, ignition means for igniting a hydrogen-rich mixture of hydrogen and oxygen, an ignition chamber into which the hydrogen inlet opens and which has a flow cross-section that widens in the direction of the flow from said hydrogen inlet toward said mixing chamber, the ignition chamber having an outlet with a cross-section smaller than the flow cross-section of the ignition chamber, the outlet of the ignition chamber and the oxygen inlet both opening into the mixing chamber, and an ignition oxygen inlet opening into the ignition chamber, the ignition means being disposed in the ignition chamber immediately upstream of its outlet, and said oxygen inlet comprising a conduit extending coaxially through the ignition chamber to said mixing chamber.

2. The injection element of claim 1, in which the oxidant inlet opening into the mixing chamber is substantially coaxially surrounded by the outlet of the ignition chamber.

3. The injection element of claim 1, in which the fuel inlet extends parallel to the longitudinal axes of the ignition chamber adjacent to the walls of the ignition chamber and over the entire periphery of the walls and opens into the ignition chamber.

4. The injection element of claim 3, in which the ignition oxidant inlet extends parallel to the longitudinal axes of the ignition chamber between a first fuel inlet adjacent to the wall of the ignition chamber and a second fuel inlet adjacent to the outer wall of the oxidant inlet and wherein the ignition oxidant inlet opens into the ignition chamber.

5. The injection element of claim 1, in which the ignition chamber includes a pre-mixing chamber between the openings of the fuel and ignition oxidant inlets on one side and the ignition means on the other side, the cross-sectional area of the pre-mixing chamber being less than the cross-sectional area of the part of the ignition chamber downstream of the pre-mixing chamber whereby the flow speed of fuel and oxidant in the pre-mixing chamber is greater than the flame propagation speed.

6. The injection element of claim 1, in which the cross-section of the mixing chamber decreases in the flow direction.

7. The injection element of claim 1, in which the ignition means is disposed in a cavity opening laterally into the ignition chamber downstream of the fuel and ignition oxidant inlets whereby fuel and oxidant flow directly past the ignition means.

8. The injection element of claim 1, in which the ignition means is a catalyst substance disposed in the ignition chamber and through which the fuel and oxidant flow.

9. The injection element of claim 1, in which the fuel inlet extends parallel to the longitudinal axes of the ignition chamber adjacent to the outer wall of the oxidant inlet and over the entire periphery of the walls of the ignition chamber and opens into the ignition chamber.

* * * * *